US011060385B2

(12) United States Patent
VanDam et al.

(10) Patent No.: US 11,060,385 B2
(45) Date of Patent: Jul. 13, 2021

(54) ARTIFICIAL LIFT SYSTEM FOR A RESOURCE EXPLORATION AND RECOVERY SYSTEM

(71) Applicants: Jeremy Daniel VanDam, W. Coxsackie, NY (US); Brian Reeves, Edmond, OK (US)

(72) Inventors: Jeremy Daniel VanDam, W. Coxsackie, NY (US); Brian Reeves, Edmond, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 247 days.

(21) Appl. No.: 16/273,824

(22) Filed: Feb. 12, 2019

(65) Prior Publication Data

US 2020/0256171 A1 Aug. 13, 2020

(51) Int. Cl.

| | |
|---|---|
| ***E21B 43/12*** | (2006.01) |
| ***E21B 33/12*** | (2006.01) |
| ***E21B 21/08*** | (2006.01) |

(52) U.S. Cl.

CPC ..... *E21B 43/124* (2013.01); *E21B 21/08* (2013.01); *E21B 33/12* (2013.01); *E21B 43/123* (2013.01)

(58) Field of Classification Search

CPC ..... E21B 43/123; E21B 43/124

See application file for complete search history.

(56) References Cited

U.S. PATENT DOCUMENTS

| | | | | |
|---|---|---|---|---|
| 3,718,407 | A * | 2/1973 | Newbrough | E21B 43/124 417/108 |
| 3,887,008 | A * | 6/1975 | Canfield | E21B 43/00 166/267 |
| 7,506,690 | B2 * | 3/2009 | Kelley | E21B 43/121 166/106 |
| 9,605,521 | B2 * | 3/2017 | Salihbegovic | F16K 41/10 |
| 9,869,164 | B2 * | 1/2018 | Tolman | E21B 43/12 |
| 2007/0114038 | A1 * | 5/2007 | Daniels | E21B 43/122 166/372 |
| 2008/0257547 | A1 * | 10/2008 | Vann | E21B 43/124 166/250.15 |
| 2009/0090503 | A1 * | 4/2009 | Groves | E21B 43/003 166/249 |

(Continued)

FOREIGN PATENT DOCUMENTS

| | | | |
|---|---|---|---|
| EP | 2666957 | A2 | 11/2013 |
| WO | 2018165352 | A1 | 9/2018 |

OTHER PUBLICATIONS

International Search Report and Written Opinion for International Application No. PCT/US2020/016503; International Filing Date Feb. 4, 2020; Report dated Jun. 2, 2020 (pp. 1-9).

*Primary Examiner* — Steven A MacDonald

(74) *Attorney, Agent, or Firm* — Cantor Colburn LLP

(57) ABSTRACT

An artificial lift system including a tubular extending into a wellbore. The tubular includes a first end arranged at a surface of a formation, a second end terminating in the wellbore, and an intermediate portion. The intermediate portion includes a plurality of gas lift valves. A jet pump is fluidically connected to the second end of the tubular. A liquid supply conduit includes a terminal end arranged at the first end of the tubular and a gas supply conduit includes a terminal end portion arranged at the first end of the tubular.

16 Claims, 1 Drawing Sheet

(56) References Cited

U.S. PATENT DOCUMENTS

| | | | | |
|---|---|---|---|---|
| 2011/0192590 | A1* | 8/2011 | Morrison | E21B 43/124 166/72 |
| 2012/0211228 | A1* | 8/2012 | Troshko | E21B 43/124 166/305.1 |
| 2013/0312833 | A1* | 11/2013 | Salihbegovic | E21B 43/123 137/1 |
| 2015/0000926 | A1* | 1/2015 | Beg | E21B 43/123 166/372 |
| 2019/0093461 | A1* | 3/2019 | Campbell | E21B 43/124 |

* cited by examiner

ARTIFICIAL LIFT SYSTEM FOR A RESOURCE EXPLORATION AND RECOVERY SYSTEM

BACKGROUND

In the resource exploration and recovery industry, various systems are employed to aid in raising formation fluids from formation to the surface. Artificial lift systems may include one or more valve that may open at predetermined pressures. A flow of gas is introduced into the wellbore and directed through the valves to create a reduction in density which acts to reduce formation back pressure and promote fluid flow. Another system may include a fluid powered jet pump that may include injecting a liquid into the formation to promote lift.

Further, it has been contemplated to combine liquid injection and gas lift systems. Unfortunately, such systems have been found to be unattractive due to the cost and complexity of providing both a liquid conduit and a gas conduit to the pump to create the motive force. For example, some artificial lift systems require high-output compressors at the surface of the formation to generate the pressurized gas. Combined systems require both the high output compressor and a high output liquid pump. Accordingly, the art would be receptive to an artificial lift system that can leverage the benefits of gas and liquid lift without the associated costs of running multiple conduits into a wellbore.

SUMMARY

Disclosed is an artificial lift system including a tubular extending into a wellbore. The tubular includes a first end arranged at a surface of a formation, a second end terminating in the wellbore, and an intermediate portion. The intermediate portion includes a plurality of gas lift valves. A jet pump is fluidically connected to the second end of the tubular. A liquid supply conduit includes a terminal end arranged at the first end of the tubular and a gas supply conduit includes a terminal end portion arranged at the first end of the tubular.

Also disclosed is a resource exploration and recovery system including a first system arranged at a surface of a formation. The first system includes fluid storage members and one or more pumps. An artificial lift system is fluidically connected to the first system. The artificial lift system includes a tubular extending into a wellbore formed in the formation from the first system. The tubular includes a first end arranged at the first system, a second end terminating in the wellbore, and an intermediate portion. The intermediate portion includes a plurality of gas lift valves. A jet pump is fluidically connected to the second end of the tubular. A liquid supply conduit includes a terminal end arranged at the first end of the tubular, and a gas supply conduit includes a terminal end portion arranged at the first end of the tubular.

Further disclosed is a method of motivating formation fluids toward a surface of a formation, the method including flowing an amount of liquid along a tubular extending into a wellbore, pooling the amount of liquid around a jet pump supported by the tubular, forcing an amount of gas along the tubular into the wellbore, urging the amount of liquid through the jet pump with the amount of gas causing formation fluids to flow into the tubular, and motivating the formation fluids to flow through the tubular by delivering the amount of gas through one or more gas lift valves provided on the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
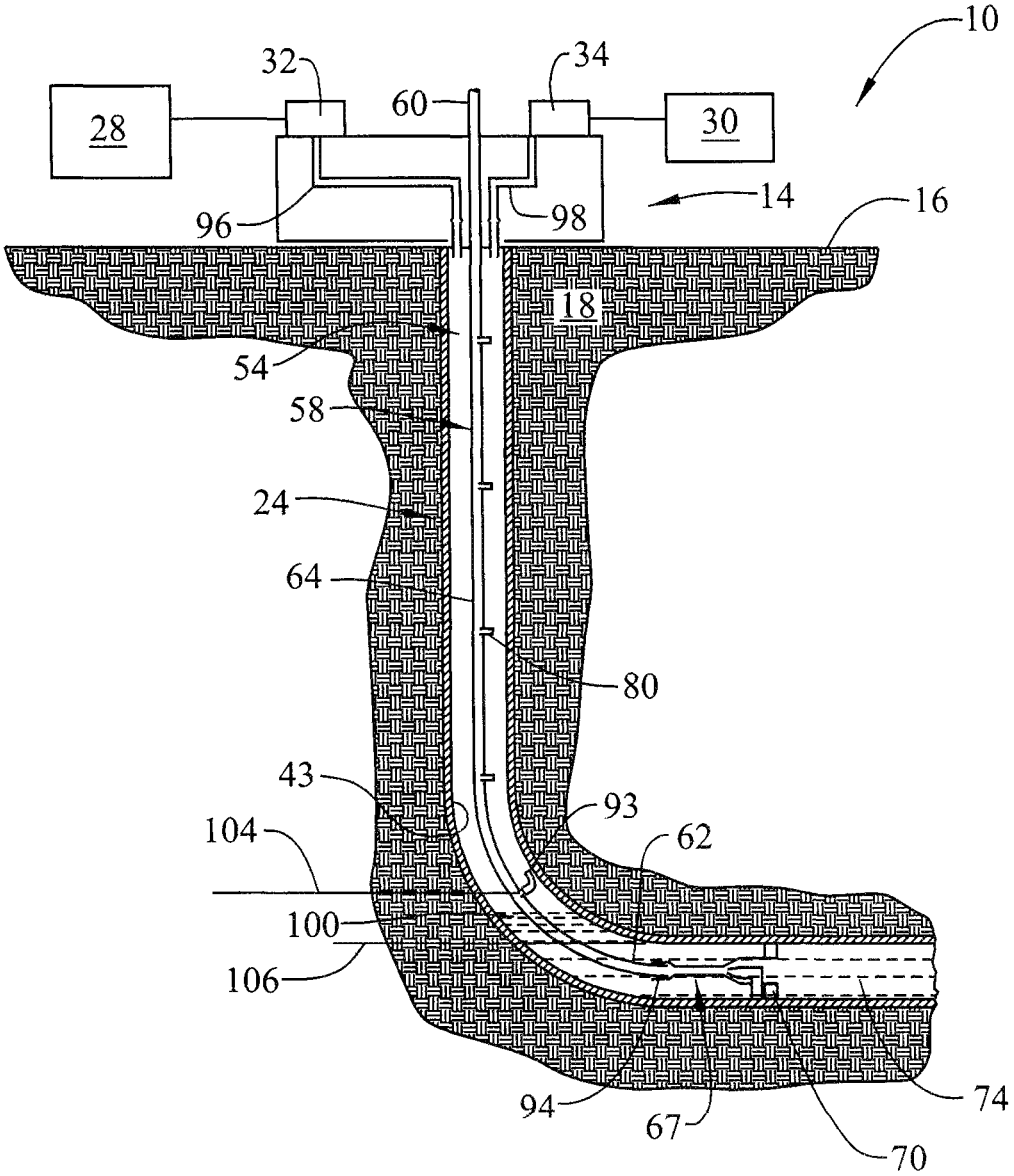
FIG. 1 depicts a resource exploration and recovery system including an artificial lift system, in accordance with an exemplary aspect.

A resource exploration and recovery system, in accordance with and exemplary aspect, is indicated generally at 10 in FIG. 1. Resource exploration and recovery system 10 includes a first system 14 that is disposed on a surface 16 of a resource bearing formation 18 and a second system 24. First system 14 include a liquid storage member 28 and a gas storage member 30 which may define a pipeline. A liquid pump 32 is fluidically connected to liquid storage member 28 and a gas pump or compressor 34 is fluidically connected to gas storage member 30.

In an embodiment second system 24 includes a wellbore (not separately labeled) that extends into formation 18 to a resource bearing zone (not separately labeled). The wellbore includes an annular wall (also not separately labeled) that may be defined by a casing tubular 43. It should be understood that the annular wall may be defined by a surface of formation 18.

In an embodiment, resource exploration and recovery system 10 includes an artificial lift and production system 54 that promotes fluid production from formation 18. Artificial lift and production system 54 includes a tubular 58 that extends into the wellbore. Tubular 58 may take the form of a single, continuous tubular such as coil tubing or a series of interconnected tubulars. Tubular 58 includes a first end 60 that is positioned at first system 14, a second end 62 that extends toward the resource bearing zone, and an intermediate portion 64.

Figure 2:
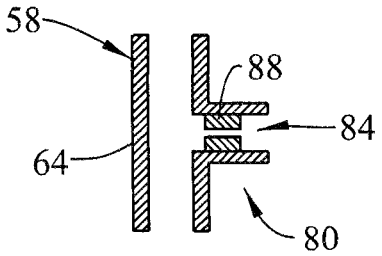
FIG. 2 depicts a gas lift valve of the artificial lift system of FIG. 1, in accordance with an aspect of an exemplary embodiment.

In an embodiment, a jet pump 67 is arranged at, and coupled to, second end 62 of tubular 58. Jet pump 67 may also be supported by a packer 70 that is arranged in the wellbore and seals against casing tubular 43. Production fluid 74 may reside at a downhole side (not separately labeled) of packer 70. In addition to jet pump 67, artificial lift and production system 54 may include a plurality of gas lift valves 80 arranged along intermediate portion 64 of tubular 58. As shown in FIG. 2, each gas lift valve 80 may include a flow restrictor 84 that achieves a selected pressure drop. In an embodiment, the selected pressure drop is greater than about a 50 PSIG (about 345 kpa) across flow restrictor 84. In another embodiment, flow restrictor 84 may take the form of a selectively adjustable orifice 88. Selectively adjustable orifice 88 enables operators to establish a selected pressure drop at each gas lift valve 80 in order to motivate liquid from annulus 43 into jet pump 67 as will be detailed herein.

In an embodiment, tubular 58 may include a first liquid level sensor 93 and a second liquid level 94 that may allow operators to establish desired liquid levels at jet pump 67 as will be detailed herein. First liquid level sensor 93 may take the form of a bottom most gas injection orifice while second liquid level sensor 94 may take the form of an intake for jet pump 67. In addition, a liquid supply conduit 96 extends from liquid pump 32 into the wellbore at surface 16. A gas supply conduit 98 extends from gas pump 34 into the wellbore at surface 16. Liquid supply conduit 96 and gas supply conduit 98 extend a short distance into the wellbore and do not reach jet pump 67 or production fluid 74.

In an embodiment, operators deliver an amount of liquid into the wellbore, the amount of liquid may be added to an upper liquid limit 104 defined by first liquid sensor 93. At this point, gas pump 34 may be activated to deliver gas from gas storage member 30 into the wellbore. The gas is delivered into the wellbore at a pressure sufficient to force the amount of liquid through jet pump 67. Liquid pump 32 may be activated to ensure that the amount of liquid remains above a lower liquid limit 106 defined by liquid sensor 94. For example, upper liquid limit 100 may be detected by a change (drop) in production rate triggered by liquid entering the bottom most gas injection orifice; and liquid at lower limit 106 may be detected be sensing a change (drop) in production rate caused by gas entering jet pump 67 in place of liquid.

As the amount of liquid flows through jet pump 67 pressure is applied to production fluid 74 downhole of packer 70. The production fluid 74 is forced up tubular 58 toward first system 14 where it may be captured for further transport or delivered into another conduit (not shown) for delivery to a next production step.

In order to enhance production, gas pressure may be increased such that the gas may be used to urge the amount of liquid into jet pump 67 and may flow into gas lift valves 80. The gas passing into tubular 58 through gas lift valves may be controlled through a selected flow restrictor to provide additional motive force to urge liquid from annulus 43 into jet pump 67. That is, the gas flows into gas lift valves 80 and drives liquid from annulus 43 into jet pump 67. At this point it should be understood that the exemplary embodiments describe a dual force artificial lift system that leverages benefits of both a jet pump and gas lift without the added cost of running multiple conduits down to a resource bearing zone.

Set forth below are some embodiments of the foregoing disclosure:

Embodiment 1

An artificial lift system comprising: a tubular extending into a wellbore, the tubular including a first end arranged at a surface of a formation, a second end terminating in the wellbore, and an intermediate portion, the intermediate portion including a plurality of gas lift valves; a jet pump fluidically connected to the second end of the tubular; a liquid supply conduit including a terminal end arranged at the first end of the tubular; and a gas supply conduit including a terminal end portion arranged at the first end of the tubular.

Embodiment 2

The artificial lift system according to any previous embodiment, further comprising: a gas pump fluidically connected to the gas supply conduit, the gas pump delivering a flow of gas that forces liquid through the jet pump and passes into the plurality of gas lift valves to motivate production fluids to the surface of the formation.

Embodiment 3

The artificial lift system according to any previous embodiment, wherein each of the plurality of gas lift valves includes an adjustable orifice.

Embodiment 4

The artificial lift system according to any previous embodiment, further comprising: a packer mounted to the tubular downhole of the second end.

Embodiment 5

The artificial lift system according to any previous embodiment, wherein the jet pump is supported at the packer.

Embodiment 6

The artificial lift system according to any previous embodiment, wherein each of the plurality of gas lift valves includes an orifice that creates a pressure drop greater than about 50 PSIG (about 345 kpa).

Embodiment 7

A resource exploration and recovery system comprising: a first system arranged at a surface of a formation, the first system including fluid storage members and one or more pumps; and an artificial lift system fluidically connected to the first system, the artificial lift system including a tubular extending into a wellbore formed in the formation from the first system, the tubular including a first end arranged at the first system, a second end terminating in the wellbore, and an intermediate portion, the intermediate portion including a plurality of gas lift valves; a jet pump fluidically connected to the second end of the tubular; a liquid supply conduit including a terminal end arranged at the first end of the tubular; and a gas supply conduit including a terminal end portion arranged at the first end of the tubular.

Embodiment 8

The resource exploration and recovery system according to any previous embodiment, wherein one of the one or more pumps of the first system delivers a flow of gas that forces liquid through the jet pump and forces gas into the plurality of gas lift valves to motivate production fluids to the surface of the formation.

Embodiment 9

The resource exploration and recovery system according to any previous embodiment, wherein each of the plurality of gas lift valves includes an adjustable orifice.

Embodiment 10

The resource exploration and recovery system according to any previous embodiment, further comprising: a packer mounted to the tubular downhole of the second end.

Embodiment 11

The resource exploration and recovery system according to any previous embodiment, wherein the jet pump is supported at the packer.

Embodiment 12

The resource exploration and recovery system according to any previous embodiment, wherein each of the plurality of gas lift valves includes an orifice that creates a pressure drop greater than about 50 PSIG (about 345 kpa).

Embodiment 13

A method of motivating formation fluids toward a surface of a formation, the method comprising: flowing an amount of liquid along a tubular extending into a wellbore; pooling the amount of liquid around a jet pump supported by the tubular; forcing an amount of gas along the tubular into the wellbore; urging the amount of liquid through the jet pump with the amount of gas causing formation fluids to flow into the tubular; and motivating the formation fluids to flow through the tubular by delivering the amount of gas through one or more gas lift valves provided on the tubular.

Embodiment 14

The method of any previous embodiment, wherein delivering the amount of gas through the one or more gas lift valves includes flowing the amount of gas through a restriction.

Embodiment 15

The method of any previous embodiment, wherein flowing the amount of gas through the restriction includes creating a pressure drop greater than about 50 PSIG (about 345 kpa).

Embodiment 16

The method of any previous embodiment, wherein flowing the amount of gas through the restriction includes creating a plurality of pressure boost zones along the tubular.

The terms "about" and "substantially" are intended to include the degree of error associated with measurement of the particular quantity based upon the equipment available at the time of filing the application. For example, "about" and/or "substantially" can include a range of ± 8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An artificial lift system comprising:

a tubular extending into a wellbore having an annulus defined about the tubular, the tubular including a first end arranged at a surface of a formation, a second end terminating in the wellbore, and an intermediate portion, the intermediate portion including a plurality of gas lift valves fluidically exposed to the annulus;

a jet pump mechanically and fluidically connected to the second end of the tubular;

a liquid supply conduit including a terminal end arranged in the annulus at the first end of the tubular uphole of the plurality of gas lift valve; and a gas supply conduit including a terminal end portion arranged in the annulus at the first end of the tubular uphole of the plurality of gas lift valves.

2. The artificial lift system according to claim 1, further comprising: a gas pump fluidically connected to the gas supply conduit, the gas pump being operable to deliver a flow of gas that forces liquid through the jet pump and passes into the plurality of gas lift valves to motivate production fluids to the surface of the formation.

3. The artificial lift system according to claim 1, wherein each of the plurality of gas lift valves includes an adjustable orifice.

4. The artificial lift system according to claim 1, further comprising: a packer mounted to the tubular downhole of the second end.

5. The artificial lift system according to claim 4, wherein the jet pump is supported at the packer.

6. The artificial lift system according to claim 1, wherein each of the plurality of gas lift valves includes an orifice that creates a pressure drop greater than about 50 PSIG (about 345 kpa).

7. A resource exploration and recovery system comprising:

a first system arranged at a surface of a formation, the first system including fluid storage members and one or more pumps; and an artificial lift system fluidically connected to the first system, the artificial lift system including a tubular extending into a wellbore having an annulus defined about the tubular formed in the formation from the first system, the tubular including a first end arranged at the first system, a second end terminating in the wellbore, and an intermediate portion, the intermediate portion including a plurality of gas lift valves fluidically exposed to the annulus;

a jet pump mechanically and fluidically connected to the second end of the tubular;

a liquid supply conduit including a terminal end arranged in the annulus at the first end of the tubular uphole of the plurality of gas lift valve; and a gas supply conduit including a terminal end portion arranged in the annulus at the first end of the tubular uphole of the plurality of gas lift valves.

8. The resource exploration and recovery system according to claim 7, wherein one of the one or more pumps of the first system is operable to deliver a flow of gas that forces liquid through the jet pump and forces gas into the plurality of gas lift valves to motivate production fluids to the surface of the formation.

9. The resource exploration and recovery system according to claim 7, wherein each of the plurality of gas lift valves includes an adjustable orifice.

10. The resource exploration and recovery system according to claim 7, further comprising: a packer mounted to the tubular downhole of the second end.

11. The resource exploration and recovery system according to claim 10, wherein the jet pump is supported at the packer.

12. The resource exploration and recovery system according to claim 7, wherein each of the plurality of gas lift valves includes an orifice that creates a pressure drop greater than about 50 PSIG (about 345 kpa).

13. A method of motivating formation fluids toward a surface of a formation, the method comprising:

flowing an amount of liquid along a tubular extending into a wellbore;

pooling the amount of liquid around a jet pump supported by the tubular;

forcing an amount of gas along the tubular into the wellbore;

urging the amount of liquid through the jet pump with the amount of gas causing formation fluids to flow into the tubular; and motivating the formation fluids to flow through the tubular by delivering the amount of gas through one or more gas lift valves provided on the tubular.

14. The method of claim 13, wherein delivering the amount of gas through the one or more gas lift valves includes flowing the amount of gas through a restriction.

15. The method of claim 14, wherein flowing the amount of gas through the restriction includes creating a pressure drop greater than about 50 PSIG (about 345 kpa).

16. The method of claim 14, wherein flowing the amount of gas through the restriction includes creating a plurality of pressure boost zones along the tubular.

* * * * *